US005163457A

United States Patent [19]

Lombardi, Jr.

[11] Patent Number: 5,163,457

[45] Date of Patent: Nov. 17, 1992

[54] TRAVEL COSMETIC COMPACT

[75] Inventor: Carl M. Lombardi, Jr., Huntington, N.Y.

[73] Assignee: Anna Young Associates, Ltd., Freeport, N.Y.

[21] Appl. No.: 884,390

[22] Filed: May 18, 1992

[51] Int. Cl.[5] ..... A45D 42/02; A65D 69/00

[52] U.S. Cl. ..... 132/304; 132/294; 132/316; 206/581; 206/235; 206/229

[58] Field of Search ..... 132/291, 293, 294, 297, 132/298, 299, 301, 303, 304, 316; 206/581, 235, 229

[56] References Cited

U.S. PATENT DOCUMENTS

| | | | |
|---|---|---|---|
| 1,549,396 | 8/1925 | Vincent | 132/294 |
| 1,895,061 | 1/1933 | Worssam | 132/294 |
| 2,534,100 | 12/1950 | Baumgartner | 206/235 |
| 4,388,935 | 6/1983 | Napolitane | 132/294 |
| 4,526,273 | 7/1985 | Tsuji et al. | 132/286 |
| 4,555,020 | 11/1985 | Campello et al. | 132/294 |
| 4,562,923 | 1/1986 | Katada et al. | 132/316 |
| 4,898,195 | 2/1990 | Sussman | 206/581 |
| 4,932,547 | 6/1990 | Rodriguez | 206/235 |

FOREIGN PATENT DOCUMENTS

| | | | |
|---|---|---|---|
| 2599949 | 12/1987 | France | 206/581 |

*Primary Examiner*—John G. Weiss

*Attorney, Agent, or Firm*—Michael Ebert

[57] ABSTRACT

A travel compact for housing a cosmetic supply and a mirror, both of which in a storage mode of the compact are encased therein, the supply and the mirror being both exposed in a utility mode whereby the user may then view her face as she applies the cosmetic thereto. The compact includes a small rectangular case having an open front end and a top wall whose front section has an open window therein. Slidable in the case through its open end is a drawer whose top wall includes in its rear section a shallow well having a mirror nested therein, a front section on which is printed identifying indicia and a deeper well intermediate the front and rear sections in which a cosmetic supply is stored. In the storage mode, the drawer is pushed fully within the case, the window in the case being then closed by the front section of the drawer to expose the indicia through the window. In the utility mode, the drawer is pulled out to an extent exposing the cosmetic supply and aligning the mirror with the window. Detent means are provided to maintain the compact in either mode.

7 Claims, 2 Drawing Sheets

TRAVEL COSMETIC COMPACT

BACKGROUND OF INVENTION

1. Field of Invention

This invention relates generally to compacts for cosmetics, and in particular to a travel compact formed by a case and a drawer slidable therein, the drawer containing a cosmetic supply and a mirror, which when the compact is in its utility mode are both exposed, and which when the compact is in its storage mode are both encased.

2. Status of Prior Art

The term makeup, in the sense this term is used in connection with cosmetics, encompasses the full range of cosmetics employed by women to beautify and color their faces. Included, therefore, in makeup are lipstick, blusher, mascara and eye shadow, as well as pressed facial powders. In some instances, these cosmetics may be applied by a finger to the user's face and in others by brushes and other applicators.

Because of the assortment of cosmetic makeup items available to the modern woman, these items are usually deployed on a mirrored dressing table or they are stored in a cosmetic cabinet or on a shelf. But when away from home, the woman will usually only take along in her purse or handbag the one or two cosmetic items she needs for a particular occasion to touch up her face to which she had already applied cosmetics. Thus when attending a party, she may bring with her only a powder compact and a lipstick.

The typical facial powder compact takes the form of an oyster-shaped container having a supply of pressed powder and a hinged lid on whose inner wall is mounted a small mirror. Not only is this compact relatively bulky, but it houses far more powder than is necessary for a given occasion. Also, when the compact is shut, the mirror then overlies the powder supply, and unless a removable cover is provided for the powder supply, the mirror will become clouded with powder, and it becomes difficult to view the face in the mirror.

In the portable cosmetic case disclosed in the Tsuji et al. U.S. Pat. No. 4,526,273, a hollow, box-like case is provided, one end of which is open to receive a sliding drawer containing compacted face powder. Attached to the outer face of the top wall of the case is a mirror that is always exposed regardless of whether the drawer is pushed in or pulled out. Hence the mirror remains unprotected even when the compact is shut and is being transported. This mirror is not only subject to breakage, but it also tends to gather dirt on its surface.

The Sussman U.S. Pat. No. 4,898,195 discloses a sliding door compact in which the drawer has a set of cells for storing a small supply of cosmetics in different shades. No mirror is included in this compact; hence the user must also take along a separate mirror. A small glass mirror placed in a purse or handbag is without protection and therefore tends to gather dust on its surface, the mirror also being subject to breakage.

The typical modern woman tends to stuff her purse or handbag with a wallet, a packet of tissues, eyeglasses, a comb, brush, and an assortment of other items; hence space is in short supply. It is desirable, therefore, that a travel compact be as small as possible so that it occupies little space in the woman's purse or handbag.

SUMMARY OF INVENTION

In view of the foregoing, the main object of this invention is to provide a travel compact in the form of a small slab so that it occupies little space in a purse or handbag, yet includes an adequate supply of a cosmetic as well as a mirror.

More particularly, an object of this invention is to provide a compact of the above type formed by a rectangular case and a drawer slidable therein containing a cosmetic supply and a mirror adjacent thereto, both of which are exposed when the drawer in its utility mode is pulled out, both of which are encased when the drawer in its storage mode is pushed in.

A significant advantage of a compact in accordance with the invention is that in its utility mode, it may be held in the palm of one hand of the user and firmly clasped while with her other hand the user applies the cosmetic to the face while viewing it in the mirror.

Also an object of the invention is to provide a compact of the above type whose case and drawer are molded of synthetic plastic material and may be mass produced at relatively low cost.

Briefly stated, these objects are attained in a travel compact for housing a cosmetic supply and a mirror, both of which in a storage mode of the compact are encased therein, the supply and the mirror being both exposed in a utility mode whereby the user may then view her face as she applies the cosmetic thereto.

The compact includes a small rectangular case having an open front end and a top wall whose front section has an open window therein. Slidable in the case through its open end is a drawer whose top wall includes in its rear section a shallow well having a mirror nested therein, a front section on which is printed identifying indicia and a deeper well intermediate the front and rear sections in which a cosmetic supply is stored. In the storage mode, the drawer is pushed fully within the case, the window in the case being then closed by the front section of the drawer to expose the indicia through the window. In the utility mode, the drawer is pulled out to an extent exposing the cosmetic supply and aligning the mirror with the window. Detent means are provided to maintain the compact in either mode.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 1:
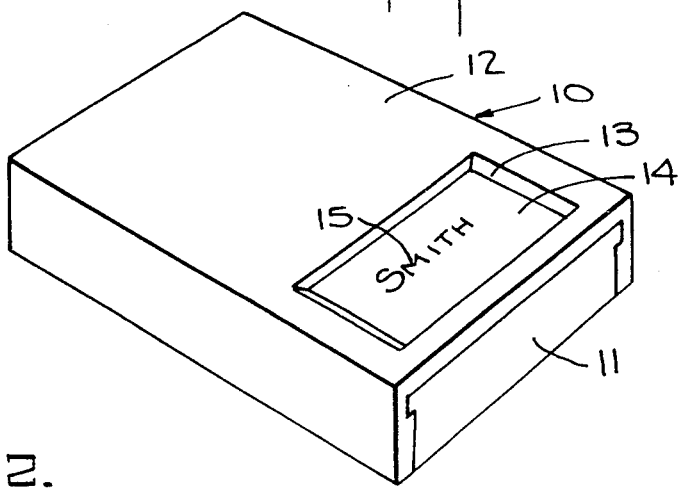
FIG. 1 is a perspective view of one preferred embodiment of a travel compact in accordance with the invention which is shown in its storage mode in condition for travel.

Referring now to FIG. 1, there is shown a preferred embodiment of a travel compact in accordance with the invention, the compact being composed of a small rectangular case 10 open at its front end, and a drawer 11 inserted in the front end of the case and slidable therein. Case 10 is provided with a planar top wall 12 whose front section has a rectangular window 13 therein.

Drawer 11 includes a top wall 14 that is parallel to the top wall 12 of the case. Imprinted on the planar front section of top wall 12 is identifying indicia 15, which when the compact is in its storage mode, as shown in FIG. 1, is visible through window 13. The indicia may be such as to identify the cosmetic housed in the compact or the maker of the compact. By way of illustration only, the indicia shown in the figures is SMITH, the maker of the compact.

Figure 2:
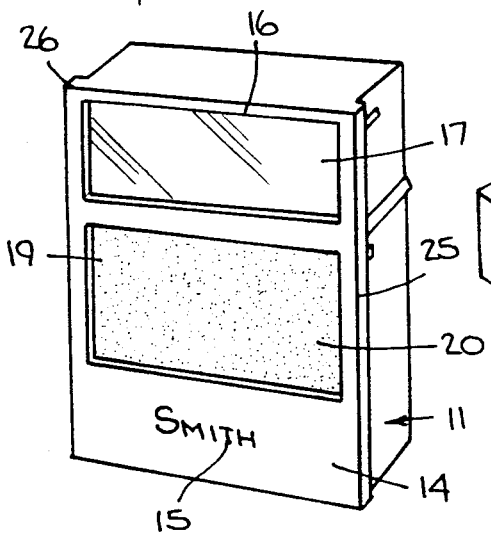
FIG. 2 separately shows, in perspective, the sliding drawer included in the compact, as seen from its top side.
Figure 3:
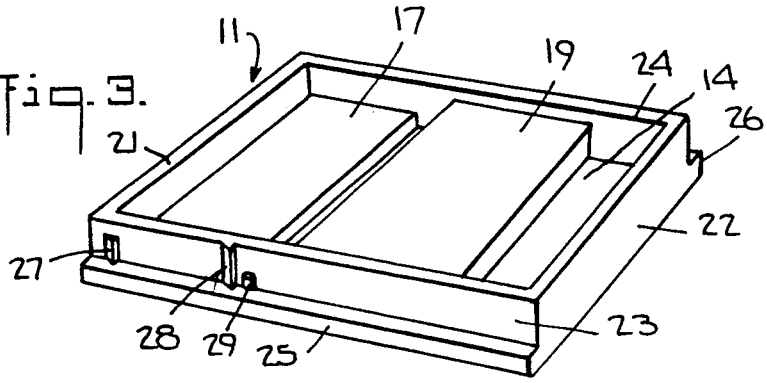
FIG. 3 shows the underside of the drawer.
Figure 6:
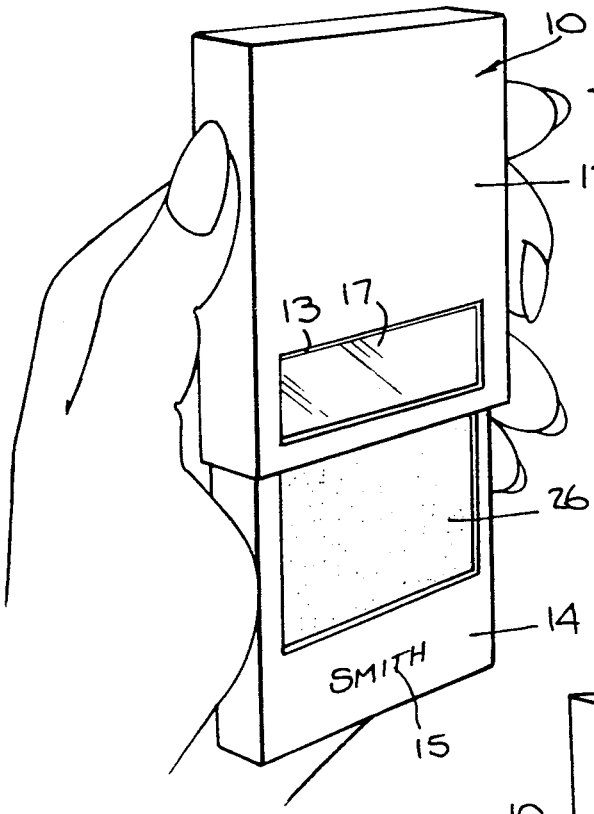
FIG. 6 shows the compact in its utility mode when held in the palm of one hand of the user.

As illustrated in FIGS. 2 and 3, the top wall 14 of drawer 11 is provided at its rear section with a shallow, rectangular well 16 within which is nested a mirror 17. Intermediate the rear and front sections of top wall 14 is a deeper rectangular well 19 containing a supply 20 of a cosmetic such as pressed facial powder.

Drawer 11 is provided with rear and front end walls 21 and 22 and parallel side walls 23 and 24. The side edges of top wall 14 extend slightly beyond the side walls to define runners 25 and 26 which slide within inner tracks formed in the side walls of case 10. The front end wall 21 of the drawer is engageable by a finger of the user to pull out the drawer.

As shown in FIG. 3, side walls 23 and 24 of the drawer are each provided with a short vertical rib 27 adjacent rear wall 21, a long vertical rib 28 whose position corresponds to the inner side of shallow well 17 containing the mirror, and a short vertical rib 29 adjacent the long rib 28 to define a detent space therebetween, as will later be explained.

Figure 4:
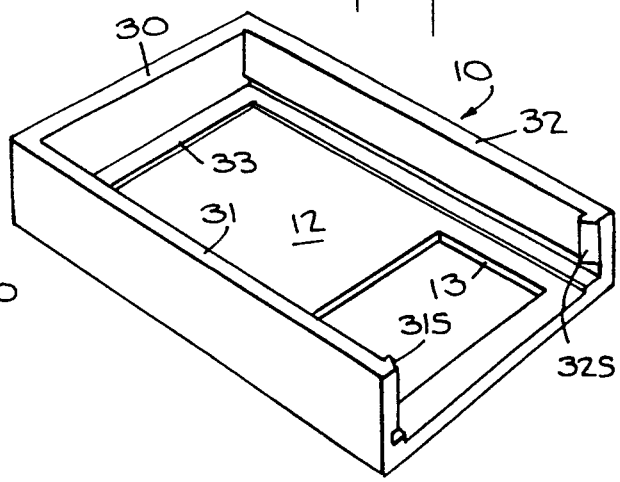
FIG. 4 separately shows the case as seen from its underside.
Figure 5:
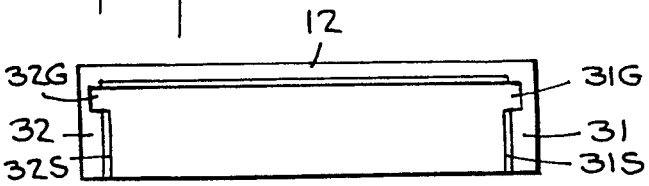
FIG. 5 is an end view of the case.

Case 10, as shown in FIGS. 4 and 5, whose front end is open, includes a rear wall 30 and parallel side walls 31 and 32 as well as window 13 in its front section. Abutting rear wall 30 and formed on the under surface of top wall 12 of the case is a transverse ledge 33. When drawer 11 is fully pushed in, ledge 33 then frictionally engages the front end margin of top wall 14 of the drawer to maintain the drawer in its storage mode.

As shown in FIG. 5, the side walls 31 and 32 of the case are provided adjacent top wall 12 with inner grooves 31G and 32G. These act as tracks to receive the runners 25 and 26 of the drawer so that the drawer is slidable in the case. At the front ends of side walls 31 and 32 are inwardly-projecting stops 31S and 32S.

Figure 7:
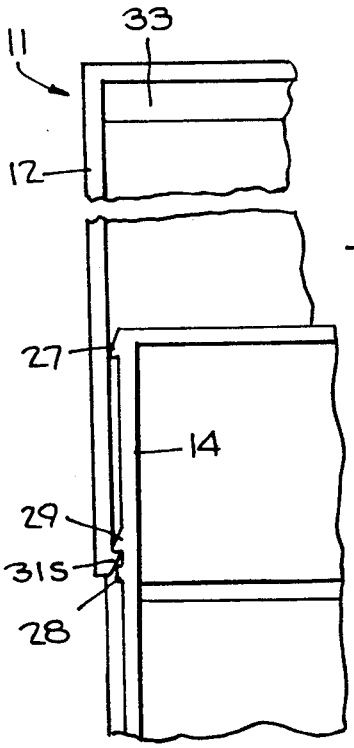
FIG. 7 illustrates the detent to maintain the compact in its utility mode.

As shown in FIG. 7, when drawer 11 is pulled out to render the compact operative in its utility mode, stops 31S and 32S of the side walls of the case are then trapped between the long and short ribs 28 and 29 on the side walls of the drawer, thereby providing a detent action. Rib 27 then serves to resist rocking movement of the drawer. However, when the drawer is pushed in fully so as to put the compact in its storage mode, the stops ride over long ribs 28 and 29 to permit the operator to push in the drawer to frictionally engage ledge 33 on the case to maintain the compact in this mode.

Both the drawer and the case are formed of resilient, moldable, synthetic plastic material such as polypropylene or polyethylene, each being separately molded. All that is necessary after the drawer and the case are molded, is to bond a mirror into the shallow well therefor in the drawer, to place a pad of pressed powder into the deeper well ,and to then telescope the drawer within the case.

Figure 8:
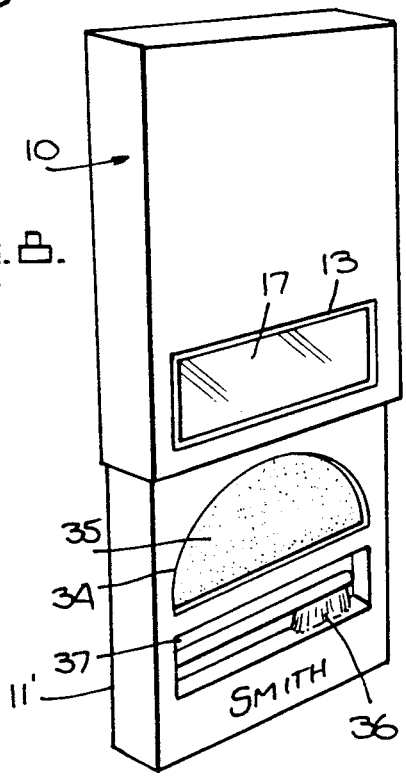
FIG. 8 shows another embodiment of the compact in its utility mode in which there are exposed a mirror, a cosmetic supply and a brush applicator for the supply.

In the embodiment of the compact shown in FIG. 8, instead of a rectangular well to receive a rectangular pad of a cosmetic, well 34 formed in the sliding drawer 11' received in case 10 is in semicircular form to store a cosmetic supply 35 having the same shape. The nature of this cosmetic, say, a mascara, is such as to require a brush applicator 36. This brush applicator is stored in a well 37 formed in drawer 11' adjacent the cosmetic supply.

In practice, instead of a single cosmetic supply, the drawer may be provided with two or more wells to accommodate more than one cosmetic supply. Because this travel compact is intended to be used away from home on occasions requiring only a small supply of cosmetic, the compact provides an adequate supply for this purpose. In one actual embodiment, the dimensions of the travel compact is $2\frac{3}{4}$ inches by $1\frac{3}{4}$ inches by 7/16 inches, thereby creating a small slab that takes little room. The user, therefore, may take along several such compacts, each containing a different cosmetic. The compact may be made even smaller to serve as a sample to be given to a potential customer who wishes to try out the cosmetic before making a purchase.

While there have been shown and described preferred embodiments of a travel cosmetic compact in accordance with the invention, it will be appreciated that many objects and modifications may be made therein without, however, departing from the essential spirit thereof.

I claim:

1. A travel compact for housing a cosmetic supply and a mirror, both of which in a storage mode are encased therein, the cosmetic supply and the mirror both being exposed in a utility mode whereby a user can then view her face as she applies the cosmetic, said compact comprising:

(a) a small rectangular case having an open front end and a planar top wall whose front section has a window formed therein; and (b) a drawer inserted in the case through said open front end and slidable therein, said drawer having a planar top wall whose rear section has a shallow well therein in which a mirror is nested and whose front section is parallel to the top wall of the case, said drawer having a deeper well intermediate said rear section and said front section in which a cosmetic supply is stored, the drawer in the storage mode of the compact being pushed fully within the case, the drawer in the utility mode being pulled out to an extent exposing the cosmetic supply and aligning the mirror with the window.

2. A travel compact as set forth in claim 1, wherein the drawer and the case are both molded of synthetic plastic material.

3. A travel compact as set forth in claim 1, wherein identifying indicia are printed on the planar front section of the drawer, which indicia are exposed through said window when the compact is in its storage mode.

4. A travel compact as set forth in claim 1, wherein said case is provided with parallel side walls, each having an inner groove therein adjacent the top wall of the case to define tracks for receiving runners formed on said drawer.

5. A travel compact as set forth in claim 4, wherein said case has a rear wall and a transverse ledge formed on the undersurface of said top wall adjacent said rear wall to frictionally engage the top wall of the drawer when it is fully pushed into the case.

6. A travel compact as set forth in claim 4, wherein said drawer is provided with side walls each having at a position corresponding to the inner edge of the shallow well in the top well of the drawer a first vertical rib and an adjacent second vertical rib to define a detent space to trap a sidewall stop formed at the open front end of the case.

7. A travel compact as set forth in claim 1, wherein the top wall of said drawer includes adjacent said deeper well a well for accommodating an applicator for the cosmetic.

* * * * *